United States Patent [19]

Ezoe

[11] 4,369,756

[45] Jan. 25, 1983

[54] PLASMA JET IGNITION SYSTEM FOR INTERNAL COMBUSTION ENGINE

[75] Inventor: Mitsuhiko Ezoe, Yokosuka, Japan

[73] Assignee: Nissan Motor Co., Ltd., Yokohama, Japan

[21] Appl. No.: 223,086

[22] Filed: Jan. 7, 1981

[30] Foreign Application Priority Data

Jan. 11, 1980 [JP] Japan ..... 55-1258
Feb. 22, 1980 [JP] Japan ..... 55-21170[U]

[51] Int. Cl.[3] ..... F02P 1/00; F02P 7/02; F02P 19/02; F02P 3/04

[52] U.S. Cl. ..... 123/620; 123/640; 123/608; 123/179 BG

[58] Field of Search ..... 123/608, 620, 640, 641, 123/179 B, 179 BG, 143 B, 310

[56] References Cited

U.S. PATENT DOCUMENTS

| | | | |
|---|---|---|---|
| 3,855,975 | 12/1974 | Masaki et al. | 123/179 BG |
| 4,122,816 | 10/1978 | Fitzgerald et al. | 123/620 |
| 4,223,656 | 9/1980 | Hamley | 123/598 |
| 4,287,862 | 9/1981 | Nuguchi et al. | 123/310 |
| 4,318,374 | 3/1982 | Yasuhara | 123/179 BG |

FOREIGN PATENT DOCUMENTS

| | | | |
|---|---|---|---|
| 2530442 | 1/1976 | Fed. Rep. of Germany . | |
| 2647881 | 5/1977 | Fed. Rep. of Germany . | |
| 2543119 | 4/1979 | Fed. Rep. of Germany . | |
| 2845819 | 8/1979 | Fed. Rep. of Germany | 123/620 |
| 1480598 | 7/1974 | United Kingdom . | |
| 2050501 | 6/1980 | United Kingdom . | |

*Primary Examiner*—Raymond A. Nelli
*Attorney, Agent, or Firm*—Lowe, King, Price & Becker

[57] ABSTRACT

A plasma jet ignition system for an internal combustion engine has a plasma jet spark plug which receives ignition energy from two energy sources, one for a spark ignition and the other for a plasma jet ignition, and performs a plasma jet ignition as well as a spark ignition. There are further provided various control circuits to control the ignition energy to reduce energy consumption and to promote the functions of the plasma jet ignition. One of these circuits is arranged to stop the plasma jet ignition during a cranking period while cranking is continued after duration of a plasma jet ignition for a predetermined time period. Another control circuit is arranged to control the plasma jet ignition energy corresponding to the engine temperature.

15 Claims, 10 Drawing Figures

PLASMA JET IGNITION SYSTEM FOR INTERNAL COMBUSTION ENGINE

BACKGROUND OF THE INVENTION

1. Field of the Invention

The present invention relates generally to a plasma jet ignition system for an internal combustion engine with particular but not exclusive application to an automobile, and more specifically to a plasma jet ignition system comprising two ignition energy sources, one for a spark ignition and the other for a plasma jet ignition, and a plasma jet spark plug which receives ignition energy from the two energy sources and performs a plasma jet ignition as well as a spark ignition.

2. Description of the Prior Art

A plasma jet spark plug for a plasma jet ignition system has two electrodes defining therebetween a spark gap and an insulating body surrounding the spark gap to form a discharge cavity of a small volume, and is provided with ignition energy from two energy sources. A spark discharge is produced between the spark gap of the plug by applying the ignition energy from a first energy source to the plug. A second energy source then supplies the ignition energy to the plug to maintain the spark discharge, thereby to produce in the discharge cavity a plasma gas of high energy, which is ejected through a spout orifice of the discharge cavity to ignite the combustible mixture.

It is known that a plasma jet ignition provides a complete and stable combustion of the combustible mixture in the combustion chamber in an engine, resulting in lower harmful engine emissions and in improvement of fuel economy. Thus a plasma jet ignition system provides a satisfactory engine performance with reliable ignition and stable combustion even at low engine load and at lean air fuel mixture in which, otherwise, poor ignition and misfire often occur. Furthermore, a plasma jet ignition system can start a cold engine very efficiently, even through fuel evaporation is so slow that the engine receives only a lean fuel mixture.

However, such a plasma jet ignition system requires a very high ignition energy, and a plasma jet spark plug must endure a very high temperature environment. A continuous high energy ignition, especially at high engine load or high engine speed, causes a rapid erosion of the electrodes of a plasma jet spark plug, and places so great an electric load on a battery and a charging system that a battery and an alternator of a large capacity are required.

Accordingly, there has been proposed an improved plasma jet ignition system which is arranged to decrease the ignition energy at high load or at high speed, where an acceptable combustion is easily obtained without a plasma jet ignition. However, such an improved system is still unsatisfactory in various ways. For example, such a system performs a plasma jet ignition during the engine cranking period, so that a plasma jet ignition together with engine cranking places an extremely large electric load on a battery. Furthermore, such a system operates in the same way whether the engine is cold or not. Therefore, the system does not provide a suitable amount of ignition energy as required in accordance with the engine temperature and results in engine operating difficulties. For example, insufficient ignition energy during cold start period causes a failure of cranking and extends the warm-up period, resulting in an increased amount of ignition power drain.

SUMMARY OF THE INVENTION

It is therefore an object of the present invention to provide a plasma jet ignition system which precisely controls the ignition energy to save unnecesary ignition power consumption and to promote the functions of plasma jet ignition.

It is another object of the present invention to provide a plasma jet ignition system which stops plasma jet ignition, leaving spark ignition only, or which restricts the ignition energy, when engine cranking is continued for a long time, so as to relieve a storage battery from overload.

It is still another object of the present invention to provide a plasma jet ignition system which supplies an adequate amount of ignition energy matched to the engine temperature.

The present invention has various features as follows: (1) During the cranking period, a plasma jet ignition is maintained only for a limited time, and engine ignition is subsequently achieved only by a spark ignition. (2) If cranking is repeated several times within a short time, the duration of plasma jet ignition during the cranking period is gradually reduced. (3) The plasma jet ignition energy is controlled in accordance with the number of cranking repetitions. (4) The plasma jet ignition energy is controlled in accordance with the engine temperature. (5) The plasma jet ignition energy is varied during a transient period such as acceleration.

According to a feature of the present invention, the plasma jet ignition system comprises a plasma jet spark plug having positive and negative electrodes forming a spark gap therebetween, and an insulating body surrounding the spark gap to form a discharge cavity with a spout orifice to eject a plasma gas produced in the discharge cavity, a first ignition source for supplying electric energy to the plug to perform a spark ignition, a second ignition energy source for supplying electric energy to the plug to perform a plasma jet ignition in addition to the spark ignition, and an energy restriction circuit which which detects an engine cranking period and restricts the energy supply from the second ignition energy source to the plug during the engine cranking period to reduce energy consumption during cranking. The energy restriction circuit may be arranged to perform the plasma jet ignition during cranking only for a predetermined period of time, and to stop the plasma jet ignition by breaking the connection of the second ignition energy source when cranking continues after the lapse of the predetermined period of time. Optionally the plasma jet ignition system comprises a temperature sensor which senses the temperature of the engine to produce a temperature signal, and an energy control circuit which receives the temperature signal from the temperature sensor and reduces the energy supply from the second ignition energy source as the sensed temperature increases.

DESCRIPTION OF THE PREFERRED EMBODIMENTS

Figure 1:
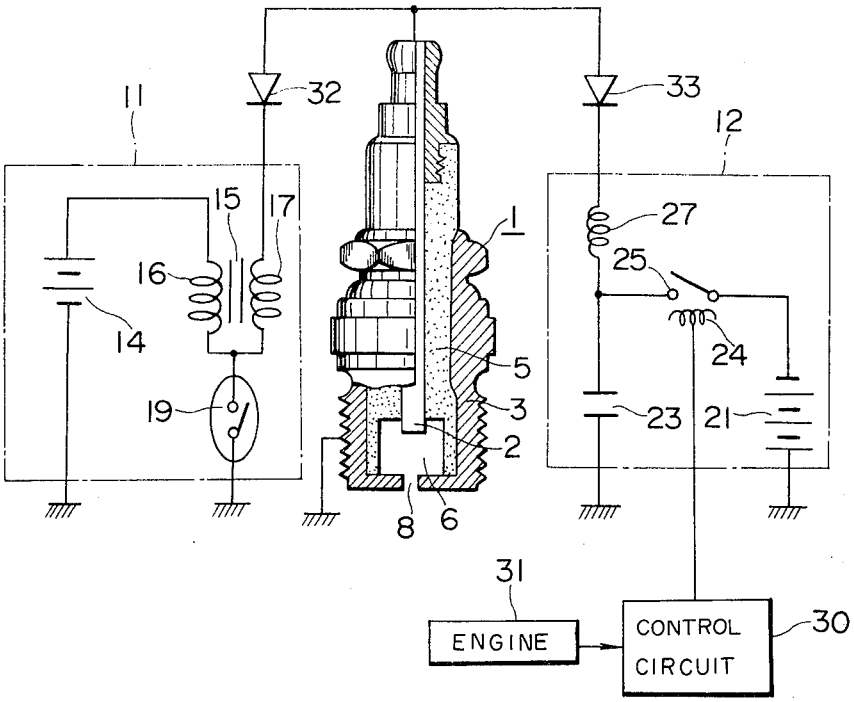
FIG. 1 (PRIOR ART)
FIG. 1 is an illustration of a conventional plasma jet ignition system.

Referring first to FIG. 1, reference will be made to a conventional plasma jet ignition system. A plasma jet spark plug 1 has a central electrode 2 and a side electrode 3, forming a spark gap therebetween. The spark gap is surrounded by an insulating member 5 of ceramic or other insulating materials, to form a discharge cavity 6 of a small volume. The plasma jet spark plug is supplied with ignition energy from two energy source circuits, a first energy source circuit 11 for a spark ignition and a second energy source circuit 12 for a plasma jet ignition. Unlike a conventional spark plug using only a spark discharge for engine ignition, the plasma jet spark plug ignites and burns an air-fuel mixture by ejecting, through a spout orifice 8, a plasma gas produced in the discharge cavity during a spark discharge. First, a high voltage (10 KV–20 KV) is applied to the plasma jet spark plug and this breaks down the insulation within the discharge cavity, and causes a spark discharge. At that time, a relatively low voltage (−3000 V, for example) is applied to the plug to maintain a spark discharge, and thus creates a plasma gas. The created gas of high energy and high temperature in the discharge cavity is ejected through the spout orifice by the aid of its thermal expansion, and ignites the combustible mixture. Thus, the plasma jet ignition system provides a reliable ignition and stable combustion even at low engine load where otherwise a misfire is liable to occur.

However, such a plasma jet ignition system requires a very high ignition energy, and a plasma jet spark plug must endure a very high temperature as mentioned before. Especially at high engine load, where a combustion temperature itself is high, a central electrode of a plasma jet spark plug wears out rapidly and even fuses partially in some cases. Furthermore, a high energy ignition at high engine speed exerts a very high electrical load on a storage battery and an alternator.

In view of the above, there has been proposed a plasma jet ignition system arranged to decrease ignition energy at high load or high speed where the engine ignitability is generally satisfactory and stable combustion can be easily obtained. For example, a plasma jet ignition system shown in FIG. 1 is arranged to stop a plasma jet ignition at high engine load. In FIG. 1, the first energy source circuit 11 for a spark ignition is the same as an energy source circuit for a conventional spark plug. That is, the first energy source circuit comprises a battery 14, an ignition coil 15 consisting of two windings, primary 16 and secondary 17, and contact points 19 arranged to open and close in response to the rotation of the crankshaft. With this arrangement, the primary energy source circuit 11 produces a high voltage (in pulses) in accordance with the movement of the contact points. On the other hand, the second energy source circuit 12 for a plasma jet ignition comprises a high voltage supply 21, a condenser 23 for storing a plasma jet ignition energy, a relay 24 and its contacts 25 for making and braking the connection between the high voltage supply 21 and the condenser 23, and a coil 27 for shaping a waveform of a current to be supplied to the plasma jet spark plug. The plasma jet ignition system further comprises a plasma jet ignition control circuit 30 which produces a command signal to command the relay 24 to switch the plasma jet ignition on or off depending on the load of the engine 31. At low engine load, the plasma jet ignition control circuit 30 produces a command signal of a high level to activate the relay 24 to close the contacts so that a plasma jet ignition energy is supplied to the plasma jet spark plug. At high load, the plasma jet ignition control circuit 30 produces a command signal having a low level to deactivate the relay 24, so that the contacts are open and plasma jet ignition energy is not supplied to the plug. Diodes 32, 33 are provided, respectively, to the primary and secondary energy source circuits for blocking current in the reverse direction.

However, a plasma jet ignition system as mentioned above is still unsatisfactory. In such a system, a plasma jet ignition is added to a spark ignition during the engine cranking period. Therefore, if engine cranking is repeated, a large electrical load caused by a plasma discharge is placed on the storage battery in addition to a large load caused by cranking the engine, which leads to an overload of the storage battery.

Figure 2:
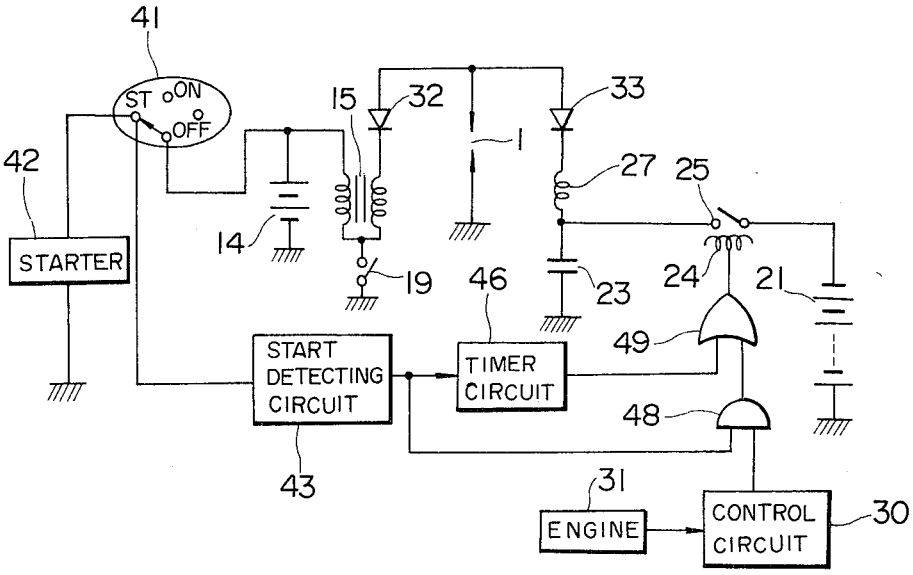
FIG. 2 is a schematic diagram showing a first embodiment of the present invention.
Figure 3:
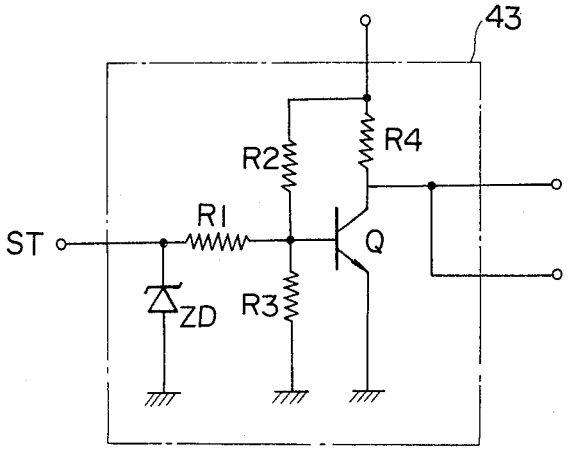
FIG. 3 is a detailed circuit diagram of a portion of FIG. 2.

In view of the above, a reference is now made to FIGS. 2 and 3, in which a first embodiment of the present invention is shown. In FIG. 2, an ignition switch 41 of the engine has a "START" ("ST") position for operating a starter motor 42, an "ON" position for keeping the engine running, and an "OFF" position for stopping the engine. There is provided a start detecting circuit 43 for detecting the ST position of the ignition switch 41, which circuit comprises, as shown in FIG. 3, a transistor Q, a constant voltage diode or Zener diode ZD, resistors R1 to R4. The start detecting circuit 43 generates a low level signal "0" when the ignition switch is in the ST position, while normally generating a high level signal "1". There is further provided a timer circuit 46, and AND gate 48 and an OR gate 49. The timer circuit 46 is composed of a monostable multivibrator, for example, and generates an ON signal for a predetermined time interval beginning at the time when the output signal of the start detecting circuit falls from "1" to "0". The AND gate 48 sends a "1" signal to one input of the OR gate when both of the output signals of the start detecting circuit 43 and the plasma jet ignition control circuit 30 are "1". The output of the timer circuit 46 is connected to the other input of the OR gate 49, whose output is connected to the relay 24.

With this arrangement, when a drive turns the ignition switch 41 to the ST position to operate the starter motor 42 through the aid of a relay (not shown), the start detecting circuit 43 detects the cranking of the engine and accordingly changes its output signal from "1" to "0". The timer circuit 46 is triggered by this fall of the output signal of the start detecting circuit and generates the ON signal during a predetermined time interval T (for example, 2 seconds). This ON signal is fed to the OR gate 49, which thus activates the relay 24 for T seconds from the start of cranking, thereby allowing a plasma jet ignition for that time interval. When the output of the start detecting circuit 43 is "0", the output of the AND gate 48 is also "0", even if the plasma jet ignition control circuit 30 sends the "1" signal to the AND gate. Therefore, at the end of the time interval of the timer circuit, the relay 24 is deactivated and thus shuts off the supply of plasma jet ignition energy after that. When the engine is running with the ignition key in the positions other than the ST position, the output of the start detecting circuit 43 is "1" so that the plasma jet ignition control circuit 30 sends its output signal through the AND gate 48 and the OR gate 49 to the relay 24 and performs the normal plasma jet ignition control.

Thus this embodiment can prevent unnecessary energy consumption caused by repetition of cranking, improve ignitability and shorten the cranking period.

Figure 4:
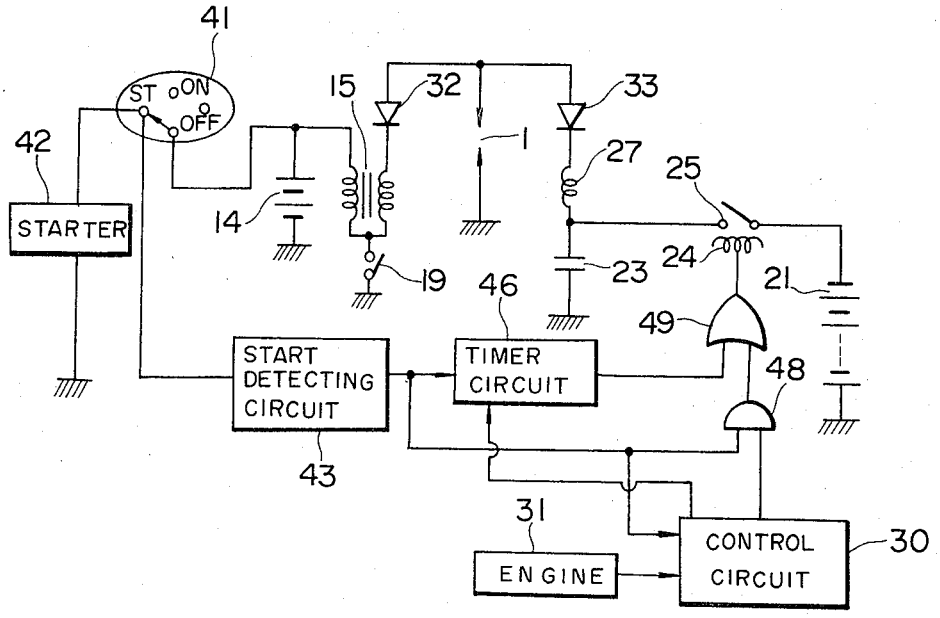
FIG. 4 is a schematic diagram showing a second embodiment of the present invention.

FIG. 4 shows a second embodiment of the present invention which is arranged to decrease the time constant of the timer circuit 46 in accordance with the number of repetitions of engine cranking within a limited time. In the circuit shown in FIG. 4, as an example, the output signal of the start detecting circuit 43 is fed to the plasma jet ignition control circuit 30 and the number of occurrences of a fall of this signal from "1" to "0" is counted by a counter. The counted number is fed to a D/A converter to produce a DC voltage which is proportional to the counted number. The timer circuit 46 is arranged to receive this DC voltage and decrease the time constant of the monostable multivibrator in accordance with the DC voltage. The counted number is reset, for example, when the ignition switch is turned to the OFF position.

Figure 5:
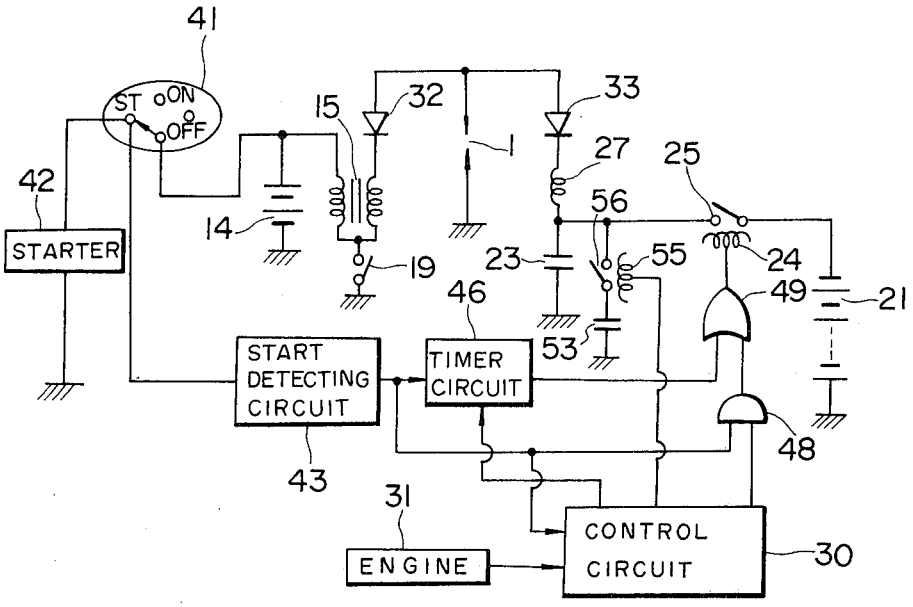
FIG. 5 is a schematic diagram showing a third embodiment of the present invention.

FIG. 5 shows the third embodiment of the present invention, in which the amount of the plasma jet ignition energy during cranking is controlled. The system of FIG. 5 is almost the same in construction as the system of FIG. 4, but further comprises a second condenser 53 in parallel to the condenser 23, for storing the plasma jet ignition energy, and a relay 55 and contacts 56 for making and breaking the connection of the second condenser 53. The relay 55 is arranged to respond to an output signal of the plasma jet ignition control circuit 30 by closing the contacts 56 for a short time after the start of cranking. Thus the system incorporates both the condenser 23 and the second condenser 53 in the circuit of the high voltage supply 21 for a short time immediately after a start of cranking, thereby providing efficient ignition. With this arrangement, the engine starts instantaneously in most cases, so that a cranking period is very short and eventually the consumption of the battery is reduced. In the system of FIG. 5, the second condenser 53 may be connected and disconnected in accordance with the counted number of repetition of cranking, so as to control the amount of the ignition energy to match the characteristic of starting of the engine. For example, the plasma jet ignition energy is maintained low until the second time of cranking by opening the contacts 56, and is increased at the third and fourth cranking times by closing the contacts 56, and then the plasma jet ignition is brought to a stop by opening the contacts 25 at and after the fifth cranking time.

Figure 6:
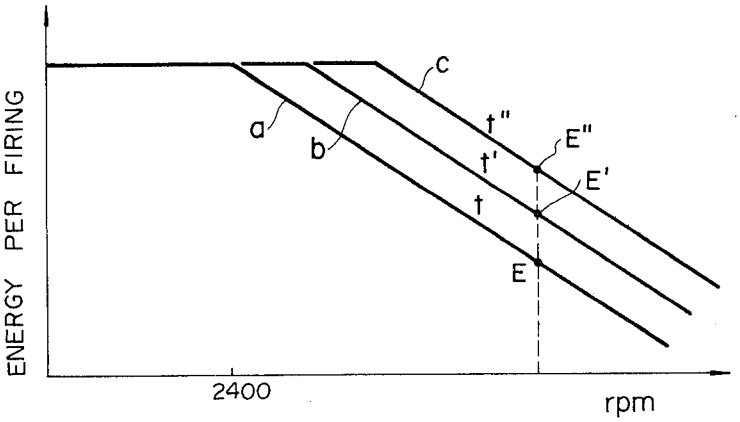
FIG. 6 is a diagram showing characteristic curves between ignition energy per firing and engine rpm.
Figure 7:
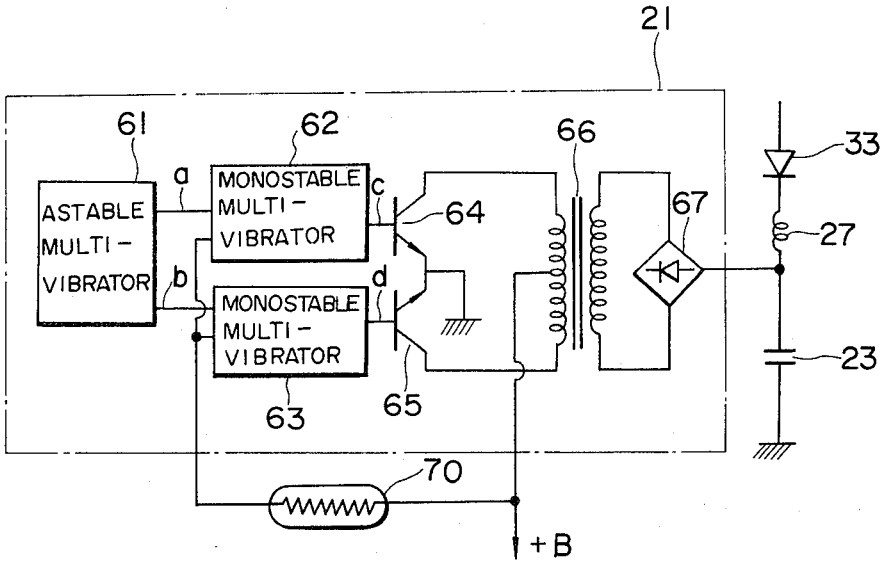
FIG. 7 is a schematic diagram showing a portion of a fourth embodiment of the present invention.
Figure 8:
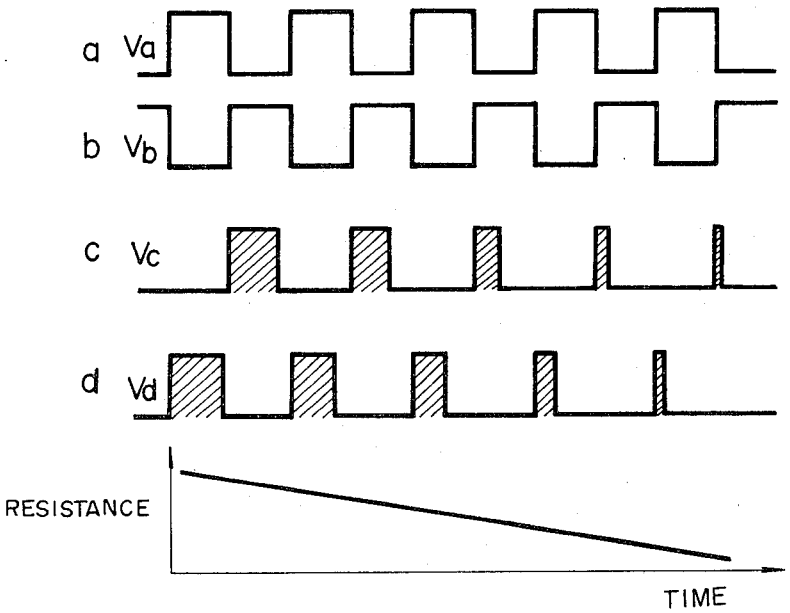
FIG. 8 is a waveform diagram for illustrating the operation of the system of FIG. 7.

Reference is now made to FIGS. 6 to 8 and the fourth embodiment of the present invention will be explained. As mentioned before, there has been proposed a plasma jet ignition system which is arranged to decrease the amount of ignition energy per firing with an increase of engine speed. Such a system controls the ignition energy independently of the engine temperature and thus exhibits a characteristic curve a of FIG. 6. Although the actual relation is more complex because of a time constant associated with charging of the condenser 23, the lines of FIG. 6 are simplified for the purpose of explanation. In such a system, the ignition energy per individual ignition is maintained constant until the engine speed reaches 2400 rpm. In the higher speed range beyond that point, the ignition energy per individual ignition is decreased in inverse proportion to the engine rpm. However, this system operates in the same way whether the engine is cold or not, and, therefore, does not provide a suitable amount of ignition energy in accordance with the engine temperature. In fact, the amount of ignition energy demanded by the engine is largely dependent upon the engine temperature, especially when the ambient temperature is much lower than the set temperature (about 80° C.) of the engine cooling water. Such conditions occur, for example, during the engine starting period and during the warm-up period. Thus the system represented by curve a can not provide a proper amount of ignition energy. The insufficient ignition energy during a cold start period, for example, causes a failure of cranking and extends the warm-up period, resulting in an increased total amount of ignition power drain and a deterioration of fuel economy.

In view of the above, the fourth embodiment of the present invention is arranged to change its characteristic curve (a, b, c) of FIG. 6 with a change of the ambient temperature ($t,t',t'':t>t'>t''$). That is, the amount of ignition energy per firing ($E,E',E''$) at fixed engine rpm is varied inversely proportionally to the ambient temperature ($t,t',t''$).

In FIG. 7, the second ignition energy source 12 comprises a power supply circuit 21, a condenser 23, a coil 27, and a diode 33. The power supply circuit 21 comprises an astable multivibrator 61, two monostable multivibrators (timers) 62, 63, two power transistors 64, 65, a transformer 66 and a rectifier 67. The astable multivibrator 61 produces a pulse signal Q having a duty ratio of approximately 50:50 and a pulse signal Q' which is an inverted version of the pulse signal Q. These signals are output on terminals a and b of the multivibrator 61. Each of the monostable multivibrators 62, 63 is triggered by a rise or a fall of the pulse signal Q or Q' and produces a pulse signal having a pulse width shorter than one half of the period of the astable multivibrator 61. The monostable multivibrators are arranged to change the pulse width of their output signals in response to variation of an external resistance introduced between an external terminal thereof and an earth terminal. The power transistors 64, 65 are connected in a push-pull circuit, driven, respectively, by the output signals of the monostable multivibrators. These transistors supply electric energy to the primary side of the transformer 66. The transistors 64, 65 have sufficient capacity to supply enough electric energy to the transformer for the plasma jet ignition, and have such a frequency characteristic that a pulse signal having the frequency of the astable multivibrator, for example 10 KHz, can be switched on and off. The transformer 66 is capable of providing a high voltage of −3000 V at the secondary side and has a small transformer loss. A center tap of the primary side of the transformer 66 is connected to the positive terminal of the storage battery. The secondary voltage is rectified by the rectifier 67 and applied to the condenser 23 for charging. For changing the pulse width of the output signals of the monostable multivibrators, there is provided between the external terminals of the monostable multivibrators and the positive terminal of the battery, a temperature sensitive resistance element 70, such as a thermistor, having a resistance inversely proportional to the engine cooling water temperature.

FIG. 8 is a timing chart showing various wave forms provided in the system of FIG. 7 on a common time base. The outputs a and b of the astable multivibrator 61 are pulse trains with a constant period and having forms inverted from each other. Each of the monostable multivibrators 62, 63 is triggered by a fall of its input pulse signal and produces an output pulse signal c, d having a pulse width which is determined by the thermistor's resistance. The output signals c and d are supplied to the transistors 64, 65, respectively and, therefore, the currents of the transistors are in phase with the signals c and d, respectively and supply electric energy to the primary side of the transformer 66. The time interval of these currents is varied in accordance with the resistance of the thermistor 70 which is sensitive to the engine cooling water temperature. The total electric energy supplied to the primary side of the transformer 66 corresponds to the summation of all hatched areas under the signals c and d in FIG. 8. The secondary voltage of the transformer 66 is rectified by the rectifier 67 and applied to the condenser 23. The thus stored electric energy in the condenser 23 is supplied to the plasma jet spark plug to achieve a plasma jet ignition immediately after a spark discharge. The characteristic of the resistance of the thermistor is important because it has a great influence on the function of the system. In some circumstances, a fixed resistance may be added in series-parallel to the thermistor, or the thermistor may be combined with another thermistor having a different characteristic or with an active element.

Thus this embodiment can supply a proper amount of ignition energy even during a cold start period and a warm-up period and always provides a desirable combustion. The system of this embodiment therefore prevents a failure of cranking and an undesired prolongation of a warm-up period. Furthermore, the ignition energy can be decreased at normal engine operating temperature in this system, so that the total power consumption of the battery is reduced. When this system is further provided with control means which controls the amount of ignition energy in accordance with the engine speed, a stable combustion condition is maintained even during a rapid acceleration or deceleration.

Figure 9:
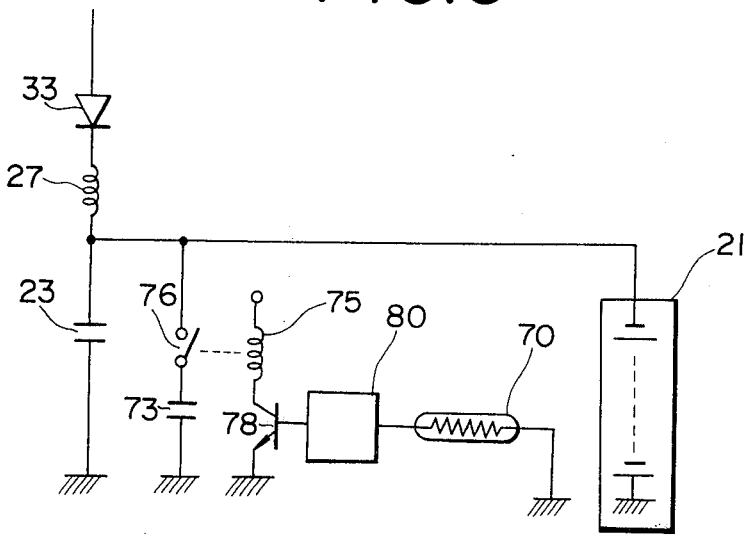
FIG. 9 is a schematic diagram showing a portion of a fifth embodiment of the present invention.

FIG. 9 shows the fifth embodiment of the present invention. In this embodiment, there are provided a plurality of second condensers 73 (Only one is shown.) connected in parallel to the condenser 23. With this arrangement, the plasma jet ignition energy is controlled by changing the capacitance in accordance with the engine temperature. The power supply 21 has enough power to charge all the condensers 23, 73 . . . . Contact set 76 makes and breaks the connection of the condenser 73. A temperature detecting circuit 80 responsive to the thermistor decides whether the engine cooling water temperature is below a predetermined temperature, and turns on a transistor 78 when the engine cooling water temperature is below the predetermined temperature. There is further provided a relay 75 arranged to close the contacts 76 to connect the second condenser 73 in parallel to the condenser 23 when the transistor 78 is turned on and the relay is energized. Thus more electric energy is supplied to the plasma jet spark plug when the second condenser 73 is added. Optionally, another second condenser is further added to provide more energy to the plasma jet spark plug when the engine cooling water temperature is still lower. To do this, there is further provided a set of contacts, a relay, a transistor and a temperature detecting circuit corresponding to the other second condenser. In this embodiment, the construction of the system is simplified.

Figure 10:
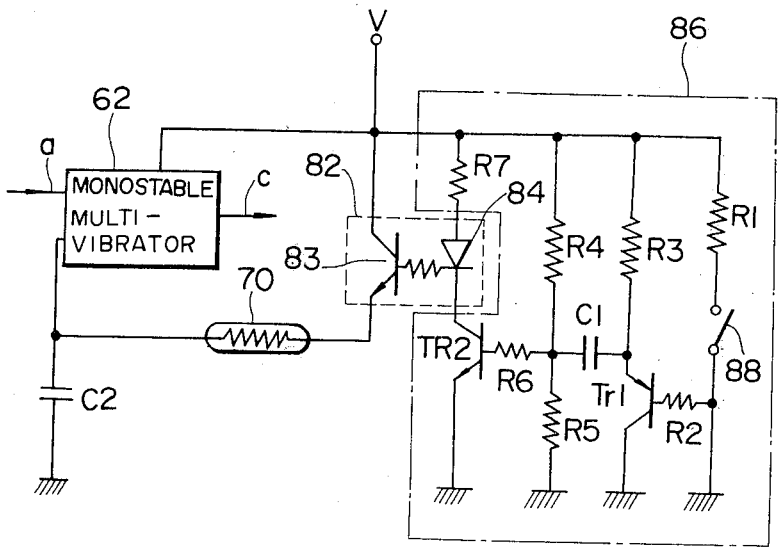
FIG. 10 is a schematic diagram showing a portion of a sixth embodiment of the present invention.

FIG. 10 shows the sixth embodiment of the present invention, in which the system of FIG. 7 is further provided with means for controlling the plasma jet ignition energy during a transient period of engine operation. In FIG. 10, there are provided a photocoupler 82 comprising a photodetector 83 and a light emitting diode 84, and a differential amplifier circuit 86 comprising transistors Tr1, Tr2, condenser C1, and resistors R1 to R7. An idle switch 88 is turned on during engine idling and turned off when the accelerator pedal is depressed. The photodetector 83 is connected in series to the thermistor responsive to the engine cooling water temperature, so that a resistance change of the photodetector exercises electrical effect on the monostable multivibrator equivalently to a resistance change of the thermistor. Thus, when the accelerator pedal is depressed to bring the engine from idling to a car running operation and the idle switch is turned off, the transistor Tr2 restricts a current through the light emitting diode for a limited time and increases an equivalent resistance of the photodetector, thus to increase the pulse width of the output pulse signal of the monostable multivibrator 62, thereby increasing the plasma jet ignition energy. Thus this embodiment provides a desirable combustion even during transient periods of engine operation where an instant increase or decrease of ignition energy is demanded.

What is claimed is:

1. A plasma jet ignition system for an internal combustion engine, said system comprising:

a plasma jet spark plug having positive and negative electrodes forming a spark gap therebetween, and an insulating body surrounding said spark gap to form a discharge cavity with a spout orifice to eject a plasma gas produced in said discharge cavity, a first ignition energy source connected for supplying electric energy to said plug to perform a spark ignition, a second ignition energy source connected for supplying electric energy to said plug to perform a plasma jet ignition in addition to the spark ignition, an energy restriction circuit means for detecting an engine cranking period and for restricting the energy supply from said second ignition energy source to said plug during the engine cranking period to reduce energy consumption during cranking.

2. A plasma jet ignition system as claimed in claim 1, wherein said energy restriction circuit means is arranged to perform the plasma jet ignition during engine cranking only for a predetermined period of time and includes means for stopping the plasma jet ignition by breaking the connection of said second ignition energy source while cranking continues after the lapse of said predetermined period of time.

3. A plasma jet ignition system as claimed in claim 2, wherein said energy restriction circuit means comprises:

a starting circuit means for detecting a start position of an ignition switch of the engine where a starter motor for the engine is driven, and for producing a start signal which is normally in an on state and which is in an off state when the ignition switch is in the start position, a timer circuit means which receives said start signal from said start detecting circuit means for producing a timer signal which is normally in an off state and is in an on state during said predetermined period of time from the time when said start signal changes from the on state to the off state, switching means which receives said start signal from said start detecting circuit means and said timer signal from said timer circuit means, for breaking the connection of said second ignition energy source to stop the plasma jet ignition when both said start signal and said timer signal are in their respective off states, while maintaining the connection of said second ignition source for other states of said start signal and said timer signal.

4. A plasma jet ignition system as claimed in claim 3, further comprising a load responsive contril circuit means which detects engine load conditions for producing a load signal which is in an on state when the engine load is below a set point and in an off state when the engine load is above said set point, and wherein said switching means is arranged to receive said load signal for breaking the connection of said second ignition energy source to stop the plasma jet ignition when said load signal is in the off state at a high engine load.

5. A plasma jet ignition system as claimed in claim 4, wherein said switching means comprises:

an AND circuit means which receives said start signal from said engine start detecting circuit means and said load signal from said load responsive control circuit means, for producing an AND signal which is in an on state when both of its input signals are in their respective on states while being in an off state for other states of its input signals, an OR circuit means which receives said timer signal from said timer circuit and said AND signal from said AND circuit, for producing an OR signal which is in an on state when either or both of its input signals is in its on state while being in an off state for other states of its input signals, a first relay means which receives said OR signal, for breaking the connection of said second ignition energy source when said OR signal is in its off state and for maintaining said connection when said OR signal is in its on state.

6. A plasma jet ignition system as claimed in claim 5, wherein said second ignition source comprises:

a power supply, a first condenser for storing electric energy from said power supply and supplying the electric energy to said plug to perform the plasma jet ignition, a second condenser connected in parallel to said first condenser for storing electric energy from said power supply and supplying the electric energy to said plug in addition to the supply from said first condenser, a second relay means for disconnecting said second condenser from the circuit of said second ignition energy source, and a second condenser control circuit means for regulating said second relay means.

7. A plasma jet ignition system as claimed in claim 6, wherein said second condenser control circuit means is connected with said start detecting circuit means to receive said start signal, and arranged for connecting said second condenser for a predetermined period of time from a start of engine cranking and, for thereafter disconnecting said second condenser to reduce the ignition energy.

8. A plasma jet ignition system as claimed in claim 5, further comprising a counter circuit means which receives said start signal from said start detecting circuit means, for counting the number of occurrences of a change of said start signal from its on state to its off state within a predetermined period of time, and for regulating said timer circuit means to make said predetermined period of time of said timer circuit means shorter with an increase of the counted number.

9. A plasma jet ignition system as claimed in claim 8, wherein said second ignition energy source comprises:

a power supply, a first condenser for storing electric energy from said power supply and supplying the electric energy to said plug to perform the plasma jet ignition, a second condenser connected in parallel to said first condenser for storing electric energy from said power supply and supplying the electric energy to said plug in addition to the supply from said first condenser, a second relay means for disconnecting said second condenser from the circuit of said second ignition energy source, a second condenser control circuit means for regulating said relay, said second condenser control circuit means being connected with said counter circuit means and arranged to disconnect said second condenser to reduce the ignition energy in accordance with the counter number of said counter circuit means.

10. A plasma jet ignition system as claimed in claim 1 or 2, further comprising:

a temperature sensor means which senses the temperature of the engine for producing a temperature signal, an energy control circuit means which receives said temperature signal from said temperature sensor means for reducing the energy supply from said second ignition energy source as the sensed temperature increases.

11. A plasma jet ignition system as claimed in claim 10, wherein said temperature sensor means comprises a resistance element having an electric resistance which is inversely proportional to the engine temperature, and wherein said energy control circuit means comprises;

an astable multivibrator for producing two pulse signals having a duty ratio of approximately 50:50, each of which is an inverted version of the other, two monostable multivibrators which are triggered, respectively, by the output signals of said astable multivibrator, and produce, each time triggered, a pulse whose width is shorter than one half of the period of said astable multivibrator, each of said monostable multivibrators being arranged to vary the pulse width of its output pulse signal in accordance with the resistance of said temperature sensor means such that the pulse width becomes wider as the engine temperature decreases, a push-pull circuit which receives the output pulse signals from said monostable multivibrators and provides electric energy, a transformer which is provided with electric energy at its primary widing from said push-pull circuit and from a power supply, and a rectifier which receives the output current from the secondary winding of said transformer and provides a rectified current for said plug.

12. A plasma jet ignition system as claimed in claim 10, wherein second ignition energy source comprises:

a power supply, a first condenser for storing electric energy from said power supply and supplying the electric energy to said plug to perform the plasma jet ignition, a plurality of second condensers each of which is connected in parallel to said first condenser for storing electric energy from said power supply and supplying the electric energy to said plug in addition to the supply from said first condenser, and a plurality of relays each of which is arranged to disconnect one of said second condensers from the circuit of said second ignition energy source, wherein said energy control circuit means comprises a second condenser control circuit means for activating said plurality of relays so as to disconnect more of said second condensers as the engine temperature increases.

13. A plasma jet ignition system as claimed in claim 10, further comprising a second energy control circuit means for detecting that an accelerator pedal for the engine is depressed from its idle position, and for increasing the electric energy supplied from said second ignition energy source to said plug for a predetermined period of time during acceleration.

14. A plasma jet ignition system for an internal combustion engine, said system comprising:

a plasma jet spark plug having positive and negative electrodes forming a spark gap therebetween, and an insulating body surrounding said spark gap to form a discharge cavity with a spout orifice to eject a plasma gas produced in said discharge cavity, a first ignition energy source for supplying electric energy to said plug to perform a spark ignition, a second ignition energy source for supplying electric energy to said plug to perform a plasma jet ignition in addition to the spark ignition, a temperature sensor means which senses the temperature of the engine for producing a temperature signal, an energy control circuit means which receives said temperature signal from said temperature sensor for reducing the energy supply from said second ignition energy source as the sensed temperature increases.

15. A plasma jet ignition system for an internal combustion engine, said system comprising:

a first ignition energy source connected for supplying electric energy to a spark plug to perform a spark ignition, a second ignition energy source connected for supplying electric energy to a spark plug to perform a plasma jet ignition in addition to the spark ignition, an energy restriction circuit means for detecting an engine cranking period and for restricting the energy supply from said second ignition energy source to a spark plug during the engine cranking period to reduce energy consumption during cranking.

* * * * *